US010260249B2

(12) United States Patent
Witelson et al.

(10) Patent No.: US 10,260,249 B2
(45) Date of Patent: Apr. 16, 2019

(54) POOL CLEANING ROBOT WITH DIRECTIONAL JET THRUSTS

(71) Applicant: Maytronics Ltd., Kibbutz Yizrael (IL)

(72) Inventors: Shay Witelson, Kibbutz Yizrael (IL); Yohanan Maggeni, Ilaniya (IL); Jackov Guy Ben-Simon, Yokneam (IL)

(73) Assignee: MAYTRONICS LTD., Kibbutz Yizrael (IL)

( * ) Notice: Subject to any disclaimer, the term of this patent is extended or adjusted under 35 U.S.C. 154(b) by 0 days.

(21) Appl. No.: 15/664,040

(22) Filed: Jul. 31, 2017

(65) Prior Publication Data

US 2019/0032356 A1 Jan. 31, 2019

(51) Int. Cl.
*E04H 4/16* (2006.01)

(52) U.S. Cl.
CPC ..... *E04H 4/1654* (2013.01)

(58) Field of Classification Search
CPC ..... E04H 4/1654
USPC ..... 210/167.16, 167.17; 15/1.7
See application file for complete search history.

(56) References Cited

U.S. PATENT DOCUMENTS 8,413,281 B2 * 4/2013 Mikuski ..... B08B 1/00 15/1.7
8,595,880 B2 12/2013 Pichon
9,091,093 B2 * 7/2015 Londono Correa .. E04H 4/1654
2002/0104790 A1 * 8/2002 Lincke ..... B01D 29/27 210/167.16
2014/0068881 A1 * 3/2014 Ben-Dov ..... E04H 4/1654 15/1.7
2014/0230168 A1 * 8/2014 Ben Dov ..... E04H 4/1654 15/1.7
2015/0143643 A1 * 5/2015 Cavagnol ..... E04H 4/1654 15/1.7
2015/0191925 A1 * 7/2015 Maggeni ..... C02F 1/001 210/85
2016/0305144 A1 * 10/2016 Maggeni ..... E04H 4/1654

FOREIGN PATENT DOCUMENTS

EP 3012386 4/2016
EP 3333343 A1 * 6/2018
WO 2012108903 8/2012

OTHER PUBLICATIONS

Search report of corresponding EP application—EP17201510.9—all three references were listed as A.

* cited by examiner

*Primary Examiner* — Fred Prince
(74) *Attorney, Agent, or Firm* — Reches Patents

(57) ABSTRACT

A pool cleaner that may include a housing; a driving motor that is configured to assist in moving the pool cleaner; a filtering element that is at least partially surrounded by the housing; an intake aperture; a first fluid conduit; and a first grille that comprises two or more movable first panes; wherein the filtering element is configured to filter fluid from the intake aperture to provide filtered fluid; wherein the first fluid conduit is configured to direct the filtered fluid towards the first grille; and wherein the first grille is configured to output the filtered fluid at a first direction that is responsive to a position of the two or more movable panes.

23 Claims, 17 Drawing Sheets

POOL CLEANING ROBOT WITH DIRECTIONAL JET THRUSTS

BACKGROUND

Cleaning robots are known in the art. Various cleaning robots are manufactured by Maytronics Ltd. of Israel and represent the state of the art of cleaning robots.

A cleaning robot is expected to clean the pool by brushing the surfaces of the pool and filtering the fluid of the pool by removing foreign particles from that fluid. The cleaning robot can be requested to move along various paths and change its direction when cleaning the pool.

Special attention is needed in the field of efficient maneuvering and navigation in the pool.

Special attention is needed in the field of efficient cleaning in difficult-to-reach areas, such as corners in the pool.

There is a growing need to provide an efficient cleaning robot at increasingly lower costs to the end users.

SUMMARY

There may be provided a pool cleaner may include a housing; a driving motor that may be configured to assist in moving the pool cleaner; a filtering element that may be at least partially surrounded by the housing; an intake aperture; a first fluid conduit; and a first grille that may include two or more movable first panes; wherein the filtering element may be configured to filter fluid from the intake aperture to provide filtered fluid; wherein the first fluid conduit may be configured to direct the filtered fluid towards the first grille; and wherein the first grille may be configured to output the filtered fluid at a first direction that may be responsive to a position of the two or more movable panes.

The two or more movable first panes may be parallel to each other.

The pool cleaner may include a first movement mechanism for moving the two or more movable first panes.

The first movement mechanism may be configured to move the two or more movable first panes while maintaining the two or more first movable panes parallel to each other.

The first movement mechanism may be configured to move the two or more movable first panes without maintaining the two or more movable first panes parallel to each other.

The first movement mechanism may be configured to independently move each first pane of the two or more movable first panes.

The first movement mechanism may be configured to move the two or more movable first panes in a synchronous manner.

The first movement mechanism may be configured to rotate the two or more movable first panes along a single axis of rotation.

The first movement mechanism may be configured to rotate the two or more movable first panes along two axes of rotation, wherein the two axes of rotation may be oriented to each other.

The first grille may be oriented in relation to a bottom of the housing.

The first grille may be positioned at a rear part of the housing.

The first grille may be positioned at a sidewall of the housing.

The first grille may be positioned at a cover of the housing.

The first fluid conduit partially surrounds the filtering element.

The pool cleaner may include a second grille that may include two or more movable second panes; a second fluid conduit; an intermediate element that may be positioned between the filtering element and the first and second fluid conduit; wherein the intermediate element may be configured to distribute the filtered fluid to at least one of the first and second fluid conduit; wherein when the second fluid conduit receives a portion of the filtered fluid, the second fluid conduit may be configured to direct the portion of the filtered fluid towards the second grille; and wherein the second grille may be configured to output the portion of the filtered fluid at a second direction that may be responsive to a position of the two or more movable second panes.

The two or more movable second panes may be parallel to each other.

The pool cleaner may include a second movement mechanism for moving the two or more movable second panes.

The second movement mechanism may be configured to move the two or more movable second panes while maintaining the two or more movable second panes parallel to each other.

The second movement mechanism may be configured to move the two or more movable second panes without maintaining the two or more movable second panes parallel to each other.

The second movement mechanism may be configured to independently move each second pane of the two or more movable second panes.

The second movement mechanism may be configured to move the two or more movable second panes in a synchronous manner.

The second movement mechanism may be configured to rotate the two or more movable second panes along a single axis of rotation.

The second movement mechanism may be configured to rotate the two or more movable second panes along two axes of rotation, wherein the two axes of rotation may be oriented to each other.

The second grille may be oriented in relation to a bottom of the housing.

The second grille may be positioned at a rear part of the housing.

The second grille may be positioned at a sidewall of the housing.

The second grille may be positioned at a cover of the housing.

The second fluid conduit partially surrounds the filtering element.

The second grille and the first grille may be positioned at a rear part of the housing.

The pool cleaner each one of the second fluid conduit and the first fluid conduit partially surrounds the filtering element.

The second grille and the first grille may be positioned at a same height.

The second grille and the first grille may be positioned at different heights.

The second grille may be positioned at a cover of the housing and the first grille may be positioned at a sidewall of the housing.

The second grille and the first grille may be arranged in a symmetrical manner about a longitudinal axis of the pool cleaner.

The second grille and the first grille may be arranged in an asymmetrical manner about a longitudinal axis of the pool cleaner.

The pool cleaner may include an intermediate element; a group of fluid conduits; and a group of grilles that may include the first grille; wherein each grill of the group of grills may include at least two movable panes; wherein the intermediate element may be configured to distribute the filtered fluid to at least one of the group of fluid conduits; wherein when a fluid conduit of the group of fluid conduits receives a portion of the filtered fluid, the fluid conduit may be configured to direct the portion of the filtered fluid towards a corresponding grille of the group of grilles; and wherein the corresponding grille may be configured to output the portion of the filtered fluid at a direction that may be responsive to a position of the at least two movable panes of the corresponding grille.

The group of grilles may include at least one upward facing grille and at least one sideway facing grille.

The group of grilles may include at least two upward facing grills and at least two sideway facing grilles.

The group of grilles may include at least one grill that may include at least two movable panes that may be configured to output a portion of the filtered fluid at a direction that may be oriented to a sidewall of the housing and may be oriented to a bottom of the housing.

The group of grilles may include at least one grille that may include at least two movable panes that may be configured to output a portion of the filtered fluid at a direction that has a projection that may be parallel to a direction of an imaginary line that stretches between a center of the pool cleaner and a corner of the housing.

The pool cleaner may include a sensor and a controller, wherein the sensor may be configured to generate detection signals indicative of a surrounding of the pool cleaner; and wherein the controller may be configured to: detect, based on the detection signals, that a corner of a pool may be within a cleaning distance from the pool cleaner; and initiate a corner cleaning process during which a grille of the group directs fluid towards the corner of the pool.

The pool cleaner may include a sensor and a controller, wherein the sensor may be configured to generate detection signals indicative of a surrounding of the pool cleaner.

The controller may be further configured to detect a vertical obstacle, based on the detection signals, so that it may perform housing angle corrections by means of adjusting panes angle of outputted fluid.

The controller may be configured to detect, based on the detection signals, that a corner of a pool may be within a cleaning distance from the pool cleaner; and initiate a corner cleaning process during which the first grille directs fluid towards the corner of the pool.

The controller may be configured to control a first movement mechanism to move the at least one first shutter pane thereby scan the corner of the pool by fluid ejected from the first grille.

The pool cleaner may include a sensor and controller, wherein the controller may be configured to control a movement of the two or more panes of the first grille during a cleaning process.

The pool cleaner may include a sensor and controller, wherein the controller may be configured to control a movement of the two or more panes of the first grille during a climbing on a sidewall of a pool.

The pool cleaner may include a sensor and controller, wherein the controller may be configured to control a movement of the two or more panes thereby increasing a pressure of a flow of fluid that exits the first grille during a climbing on a sidewall of a pool.

The pool cleaner may include a sensor and controller, wherein the controller may be configured to control a movement of the two or more panes of the first grille during a climbing on stairs of a pool.

A method for operating a pool cleaner, the method may include assisting, by a driving motor of the pool cleaner, in moving the pool cleaner; filtering, by a filtering element of the pool cleaner, fluid from the intake aperture to provide filtered fluid; directing, by a first fluid conduit of the pool cleaner, the filtered fluid towards a first grille of the pool cleaner; wherein the first grille may include at least two movable panes; and outputting, by the first grille the filtered fluid at a first direction that may be responsive to a position of the two or more movable panes.

The method further may include controlling a position of the at least two movable panes.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
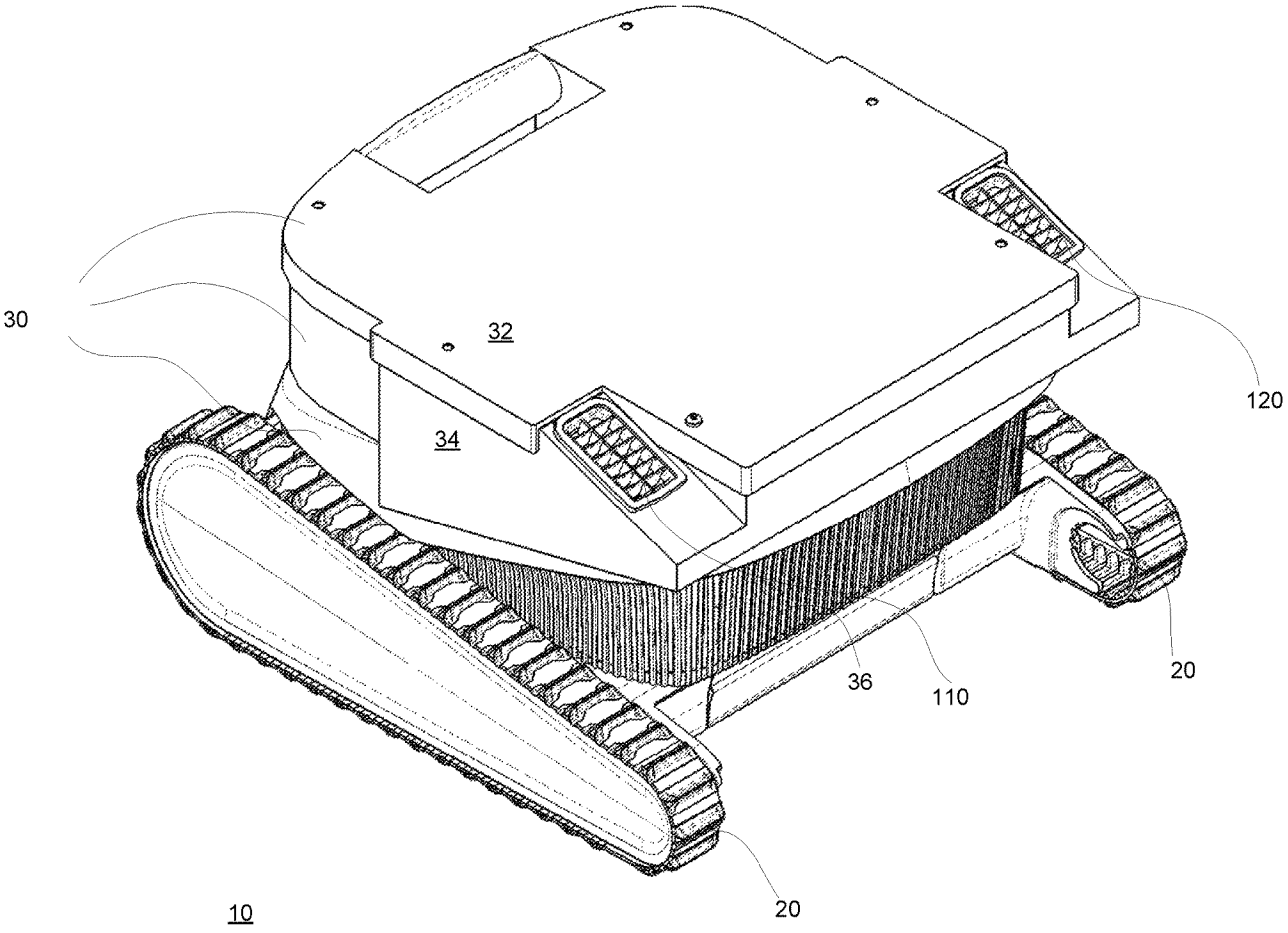
FIG. 1 illustrates an example of a pool cleaner.
Figure 2:
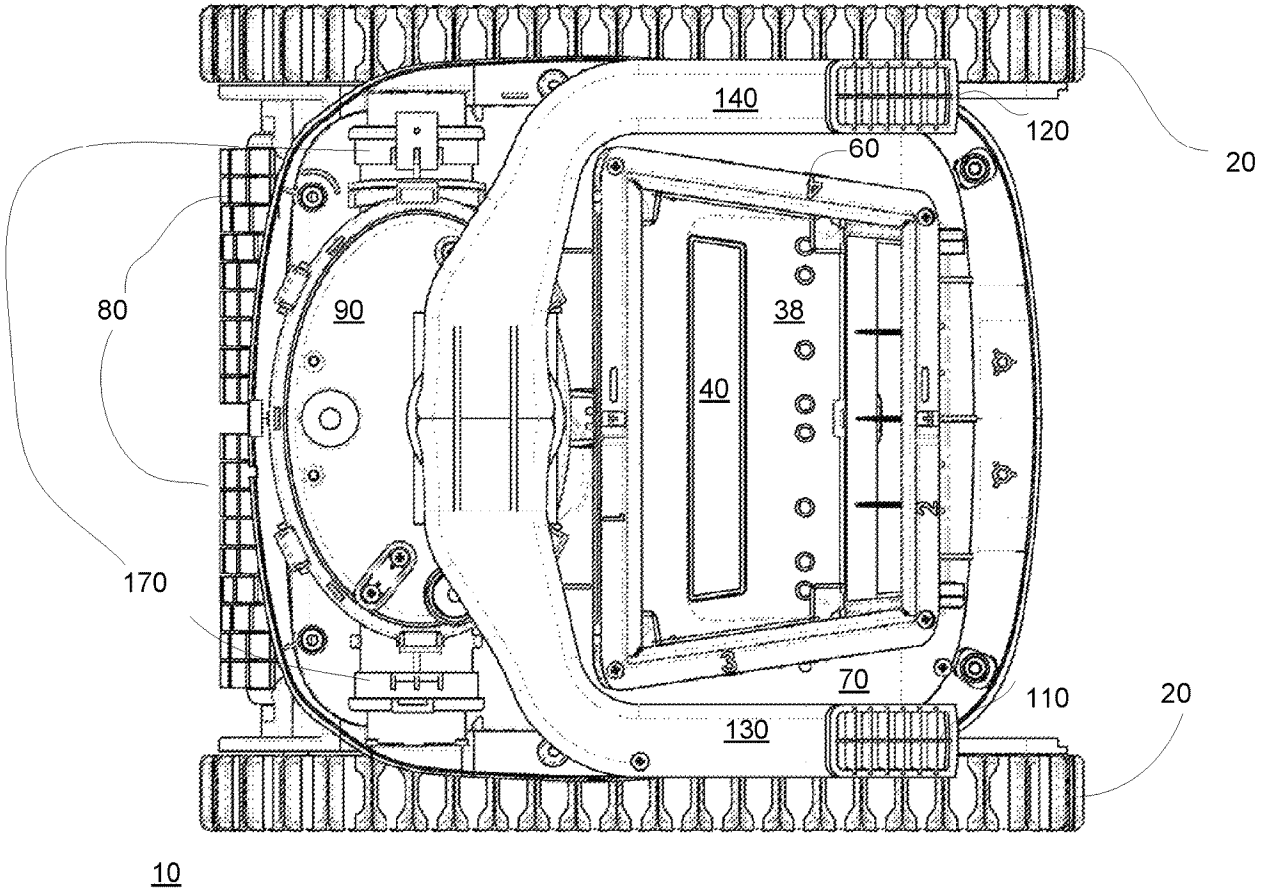
FIG. 2 illustrates a top view of an example of a pool cleaner without a cover.
Figure 3:
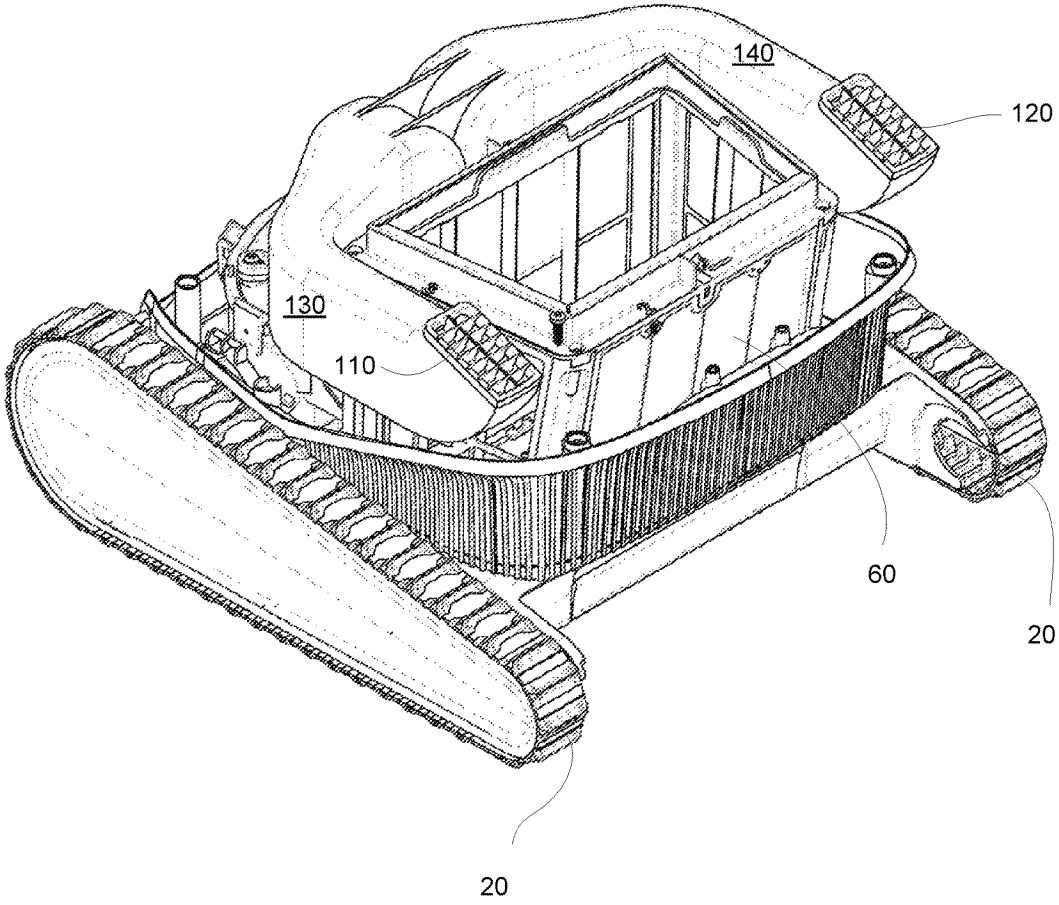
FIG. 3 is a top sectional view of an example of a pool cleaner.
Figure 4:
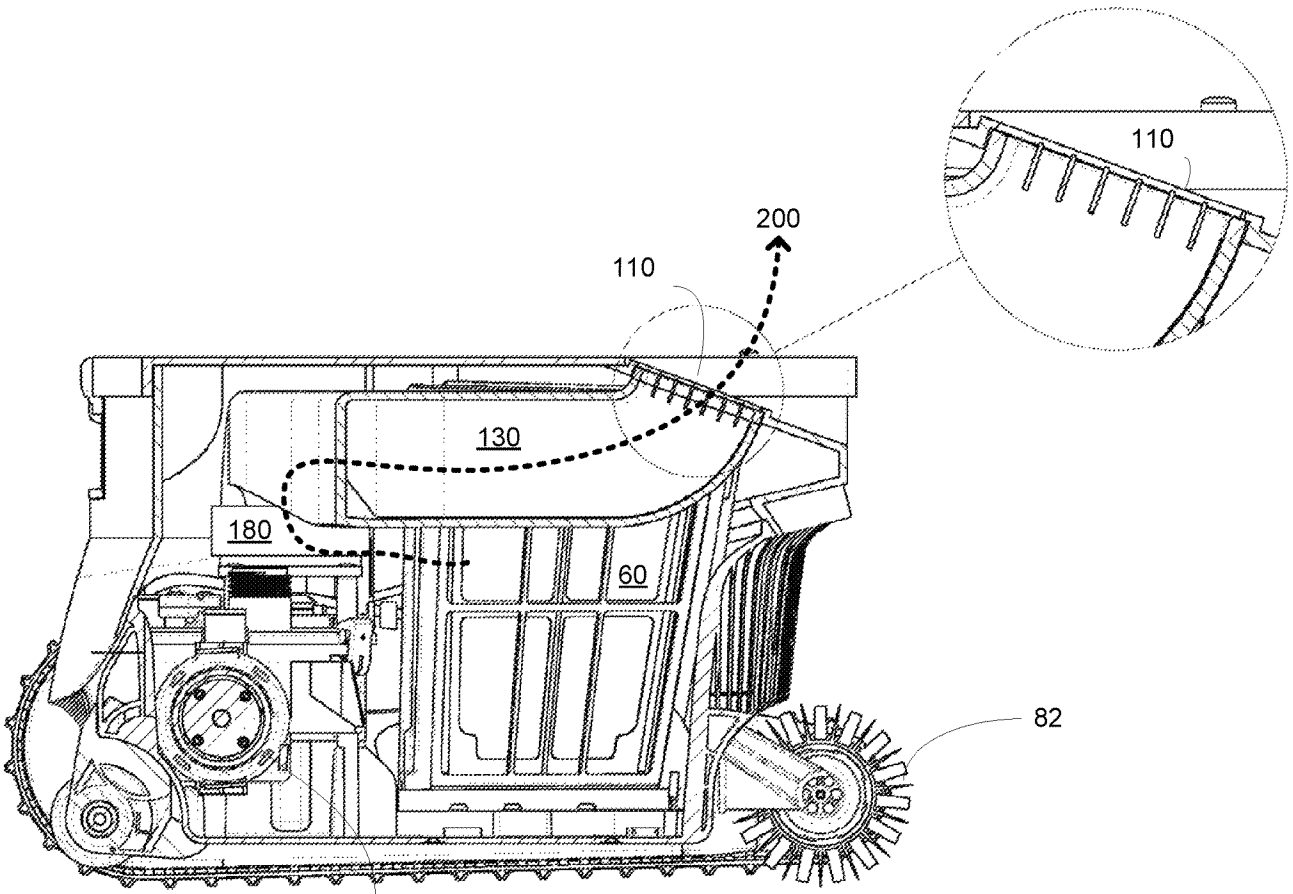
FIG. 4 is a side cross sectional view of an example of a pool cleaner.
Figure 5:
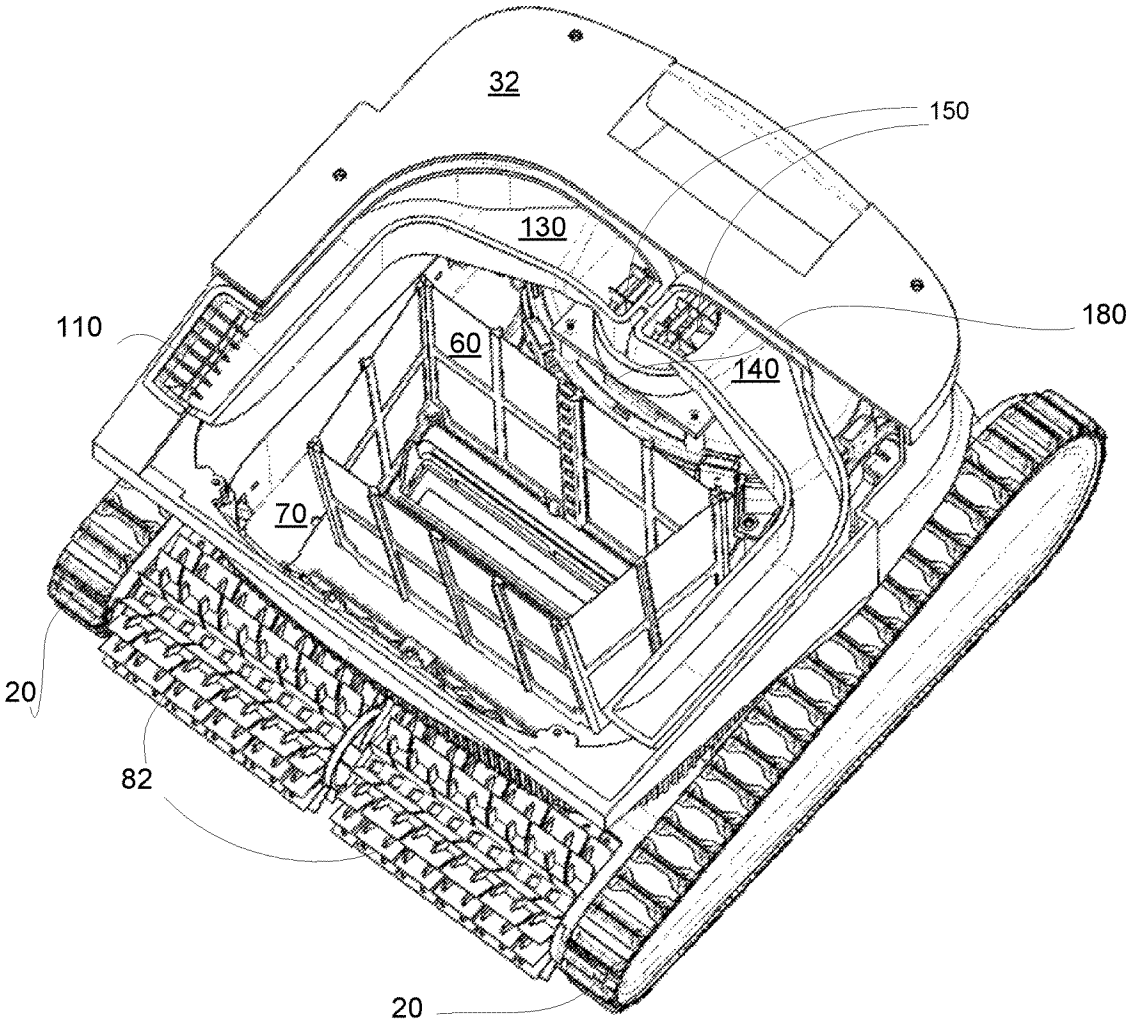
FIG. 5 is a top cross sectional view of an example of a pool cleaner.
Figure 6:
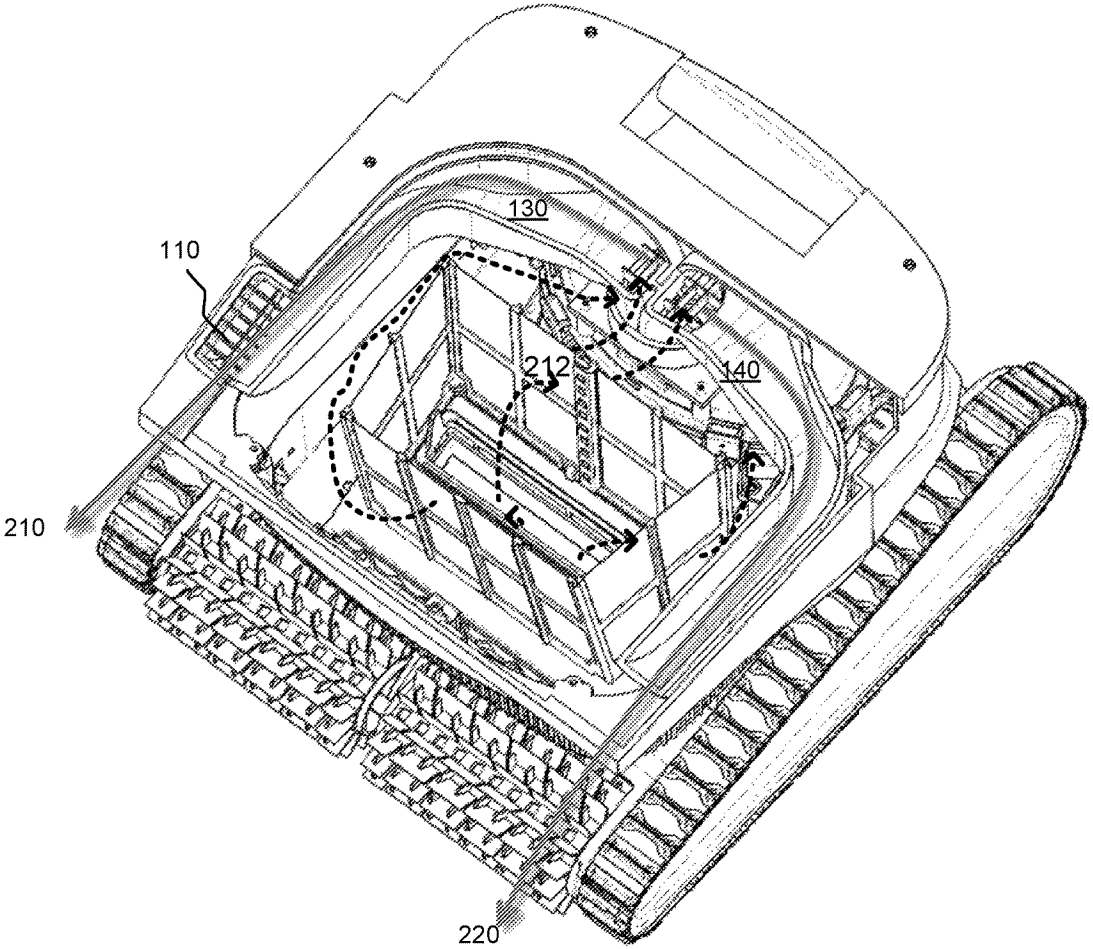
FIG. 6 is a top cross sectional view of an example of a pool cleaner.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

Any reference to a pool cleaner should be applied, mutatis mutandis to a method that is executed by a pool cleaner and/or to a non-transitory computer readable medium that stores instructions that once executed by the pool cleaner will cause the pool cleaner to execute the method.

Any reference to method should be applied, mutatis mutandis to a pool cleaner that is configured to execute the method and/or to a non-transitory computer readable medium that stores instructions that once executed by the pool cleaner will cause the pool cleaner to execute the method.

Any reference to a non-transitory computer readable medium should be applied, mutatis mutandis to a method that is executed by a pool cleaner and/or a pool cleaner that is configured to execute the instructions stored in the non-transitory computer readable medium.

There may be provided a pool cleaner that may eject fluid jet that follow predefined patterns—including patterns that may or may not differ from mostly random movements of tentacles or jets directed from the pool cleaner underside towards the floor in order to agitate the dirt and facilitate pump dirt intake suction.

There is provided a pool cleaner that is efficient and cheap by using precise pre-programmed automatic directional controls of fluid jet propulsions for both cleaning and/or navigation in difficult to reach pool areas.

FIGS. 1-7 illustrate non-limiting examples of a pool cleaner 10 that includes housing 30, tracks 20 and their tracks housing side covers, water intake aperture 40, filtering and/or sieving element (hereinafter—filtering element) 60 positioned within inner space 70, front brush wheels 80, rear brush wheels 82, housing 90 for storing a pumping motor (not shown) and a driving motor (not shown) and an electronic control or control box (not shown), reduction gears 170, left grille 110, right grille 120, left fluid conduit 130, right fluid conduit 140, input apertures and grilles of left and right fluid conduits 150, and intermediate element 180 (such as a fluid distribution unit and/or a hollow and apertured unit).

Intermediate element 180 may include one or more valves and/or shutters or any other element for distributing the fluid between the left and right fluid conduits.

The intermediate element 180 may distribute the fluid evenly between the left fluid conduit 130 and the right fluid conduit 140, may distribute the fluid in an uneven manner between the left fluid conduit 130 and the right fluid conduit 140, may maintain a fixed distribution of fluid between the left fluid conduit 130 and the right fluid conduit 140, and/or may change the distribution of fluid between the left fluid conduit 130 and the right fluid conduit 140 over time. Changes over time may be applied during a dynamic steering/jet propulsion/maneuvering scheme.

The intermediate element 180 may include a nozzle manipulator that is connected to the nozzle and arranged to rotate the nozzle about an nozzle axis such as to alter an orientation of the nozzle in relation to an imaginary longitudinal axis of the housing whereby the nozzle may be co-axial with the said longitudinal axis; a fluid interfacing section arranged to direct fluid from the nozzle (a) towards the right fluid conduit when the nozzle is at a first orientation, and (b) towards the left fluid conduit when the nozzle is at a second orientation; the first orientation differs from the second orientation (c) towards both the left and/or the right fluid conduits, each at controlled varying levels of power thrusts, that may be adjusted by electronic commands from the control box (d) towards additional conduits.

The selection between the left fluid conduit and the right fluid conduit may be responsive to an operational mode of the impeller.

The selection between the left fluid conduit and the right fluid conduit may be responsive to an operational mode of the control box subject to, for example, when the sensors detect that the cleaning robot is in a vertical position while climbing a wall or pool stairs.

In FIGS. 1-7 left grille 110 and right grille 120 face upwards and may be regarded as upward facing grilles.

Any one of right grille 120 and left grille 110 may be a movable grille that can move one or more panes up and/or down and/or sideways for automatic programmed navigation maneuvering.

Although FIGS. 1-7 illustrate two fluid conduits (left and right) that number of fluid conduits may differ from two—and especially may exceed two. For example—FIGS. 8-12 and 16 illustrate four grilles.

Although FIGS. 1-7 illustrate two fluid conduits (left and right) that are of the same height—the fluid conduits may be positioned at different heights. For example, the pool cleaner may include a third fluid conduit that is positioned above cover 32 of the housing and has a rear opening.

Although FIGS. 1-7 illustrate two fluid conduits (left and right) that are arranged in a symmetrical manner about a longitudinal axis of the pool cleaner—the fluid conduits may be positioned in an asymmetrical manner in relation to the longitudinal axis of the pool cleaner.

Although FIGS. 1-7 illustrate two fluid conduits that have apertures that are oriented backwards and upwards—at small deviation from the horizon—the fluid conduit apertures may be oriented purely upwards, purely rearwards, to the left, to the right—or in any other orientation.

Although FIGS. 1-7 illustrate two grilles—the pool cleaner may not include such grilles.

It is beneficial that the fluid conduit apertures are positioned at the rear portion (rear half) of the pool cleaner—and especially much closer to the rear end of the housing than to the front end of the housing. For example, assuming that the length of the pool cleaner is L—the centre of one or more fluid conduit aperture can be located at a distance of L/F from the rear end of the housing, F being a positive number that may exceed two (for example 2-2.5, 3. 3.3, 3.5, 4, 4.6, 5 . . . ).

When the pool cleaner operates in a cleaning mode fluid enters through water intake aperture 40, is filtered of otherwise processes by filtering and/or sieving element 60, flow through inner space 70, enters intermediate element 180 and flows through at least one (depending upon the distribution of fluid applied by intermediate element 180) of left fluid conduit 130 and right fluid conduit 140—and exits through at least one of left fluid conduit aperture and left fluid conduit aperture grille 110 and right fluid conduit aperture and left fluid conduit aperture grille 120. The flow of fluid is illustrated by dashed arrows 200, 210, 212 and 220 in FIGS. 4 and 6. The fluid may be sucked by pump motor (not shown). The fluid may be drawn from any side of the filtering and/or sieving unit 60.

The location of the water intake inlet or inlets is not limited to current depictions and may be located anywhere at the bottom of the housing such at the center of the bottom.

The housing may be constructed in a symmetrical or non-symmetrical manner.

The pool cleaner may output fluid from sideway openings for navigation maneuvering.

Figure 7:
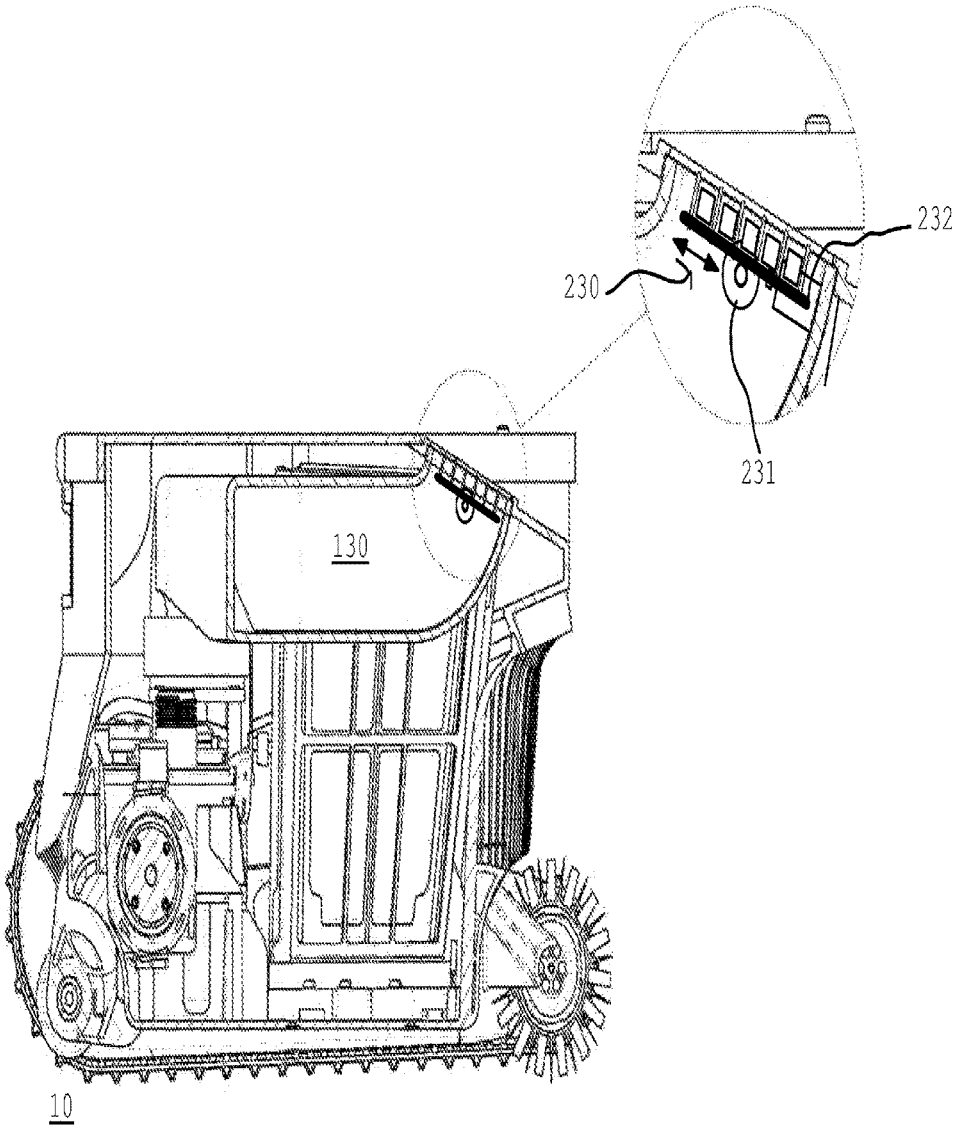
FIG. 7 is a side cross sectional view of an example of a pool cleaner.

FIG. 7 illustrates a driving mechanism 230 that may include a motor 231 and a rod 232 that is connected to all panes of grille 110. Rotational movements of motor 231 are translated to linear movements of rod 232, wherein linear movements of rod rotates the panes about their axis and change the angle between the aperture of the left fluid conduit 130 and the panes. Motor 231 may be an independent linear and rotary motions singular type motor that is offered by the company LinMot from Spreitenbach, Switzerland.

FIGS. 8-12 and 16 illustrates two additional grilles such as right sideway facing grille 240 and left sideway facing grille 250.

Any one of right sideway facing grill 240 and left sideway facing grille 250 may be a movable grille that can both independently move one or more panes up and/or down and/or sideways for automatic programmed navigation maneuvering.

The two sideway facing grills (240 and 250) may be positioned at the same height or at different heights. There may be one sideway facing grille or three or more sideway facing grille. A sideway facing grille may be positioned at a sidewall of the housing, at a corner of the housing and the like.

When the pool cleaner has multiple grilles—these grilles may have the same size and/or the same structure and/or same dimension. One or more grille may differ from one or more other grilles by size and/or structure and/or dimension. Structure may include the number of panes, the orientation of the panes (for example vertical and/or horizontal or oriented by an angle that ranges between one and ninety degrees), the manner for controlling the panes (independently, in tandem), and the like.

Figure 8:
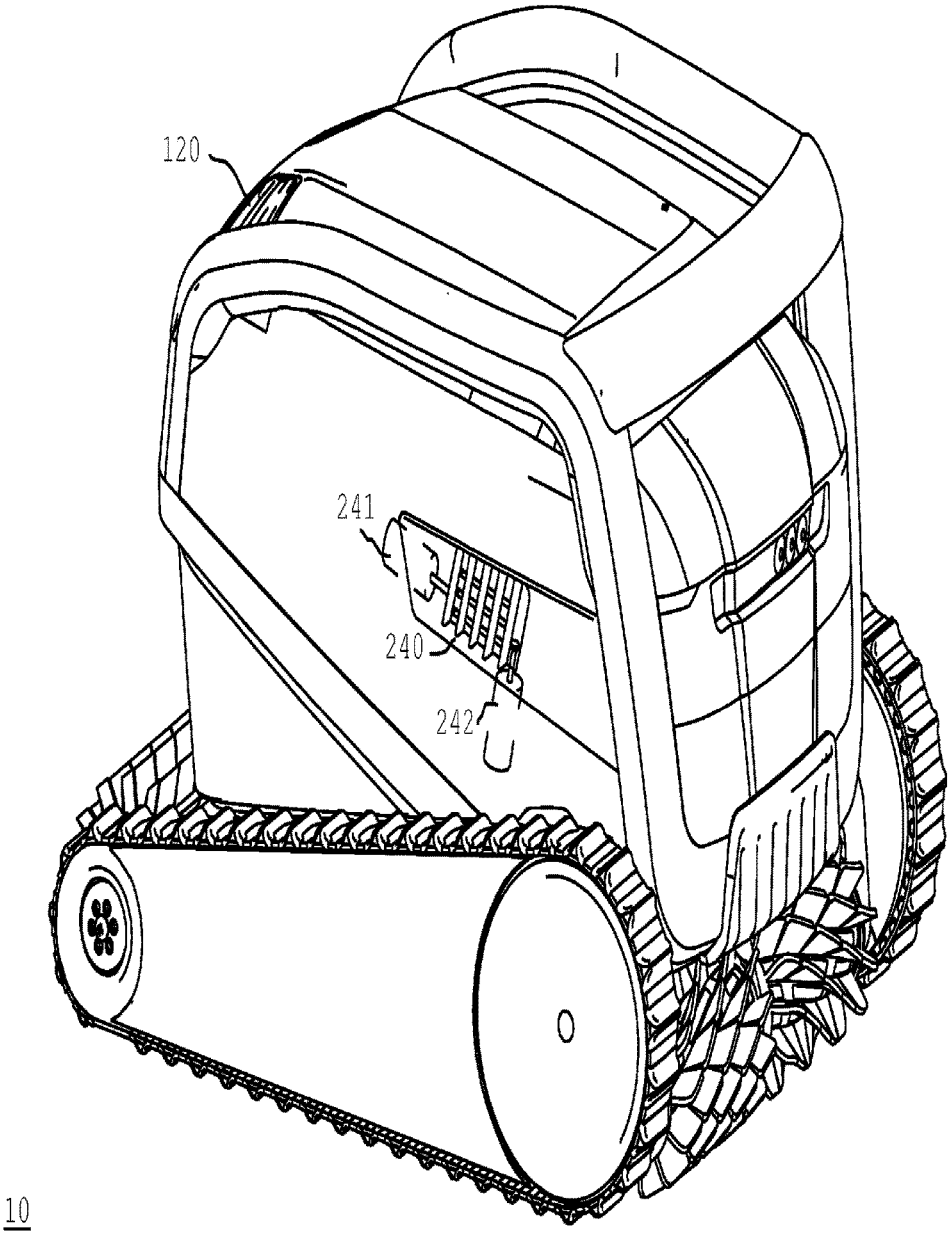
FIG. 8 illustrates an example of a pool cleaner.

FIG. 8 illustrates right sideway facing grille 240 that has vertical panes that are moved by a gear that is mechanically coupled to first motor 242, and has horizontal panes that are moved by a gear that is mechanically coupled to second motor 241.

Figure 9:
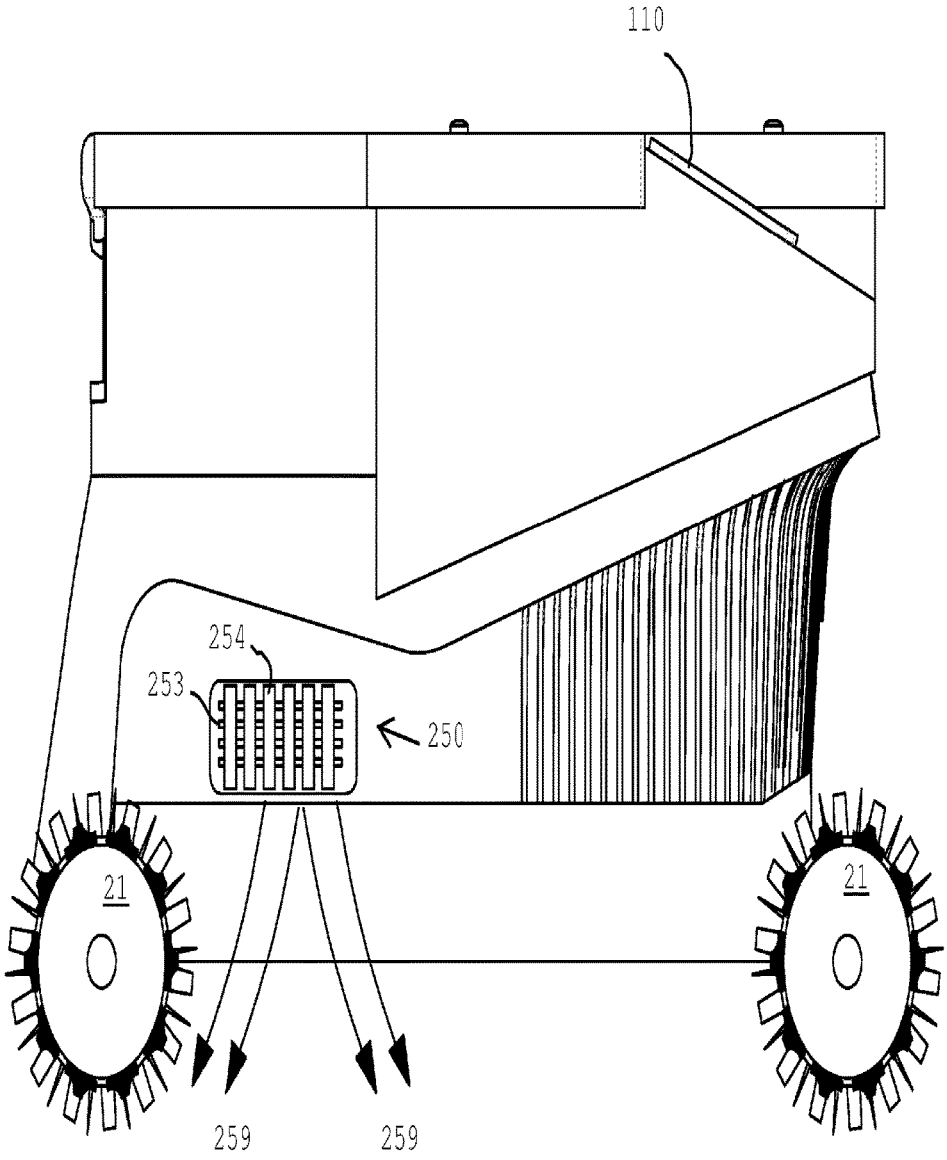
FIG. 9 is a side view of an example of a pool cleaner.

FIG. 9 illustrates left sideway facing grille 250 located in a lower area of the housing that has vertical panes 254 and horizontal panes 253 that are moved by a movement mechanism (not shown). FIG. 9 also illustrates flow of fluid 259 that exits the right sideway facing grille 240 and that may also flow through an opening in the tracks housing side covers (not shown). The direction of flow of fluid 259 depends on the orientation of the sidewall apertures that is followed by right sideway facing grille 240 and by the position of the vertical panes 254 and the horizontal panes 253.

Fluid may exit from sideway openings for directionally moving jet thrusts at corners to remove dirt while navigating.

Fan movements of the panes ensure that stubborn cornered dirt can be removed in difficult to reach areas. The fan movements may be in a horizontal 'up-and-down' pane movement mode or in a vertical 'sideways' movement mode.

Moreover, closing the gaps between each two panes in the shutter may increase the velocity of outputted fluid thrusts thereby increasing the imparted force by which the fluid impacts the pool surfaces and/or the layered dirt.

Corners of the pool in this specification comprise any two pool surfaces meeting such as the corner formed at the meeting of one wall and the floor or at the meeting of two walls and the floor.

A vertical obstacle in the pool, in this specification, comprise a wall or a staircase that may be climbed upon.

Corners may be hard to clean, as the pool cleaner may be prevented from reaching the corners. Cleaning of the corners using fluid flows (jets) may simplify the cleaning process and make the cleaning process more efficient.

Figure 10:
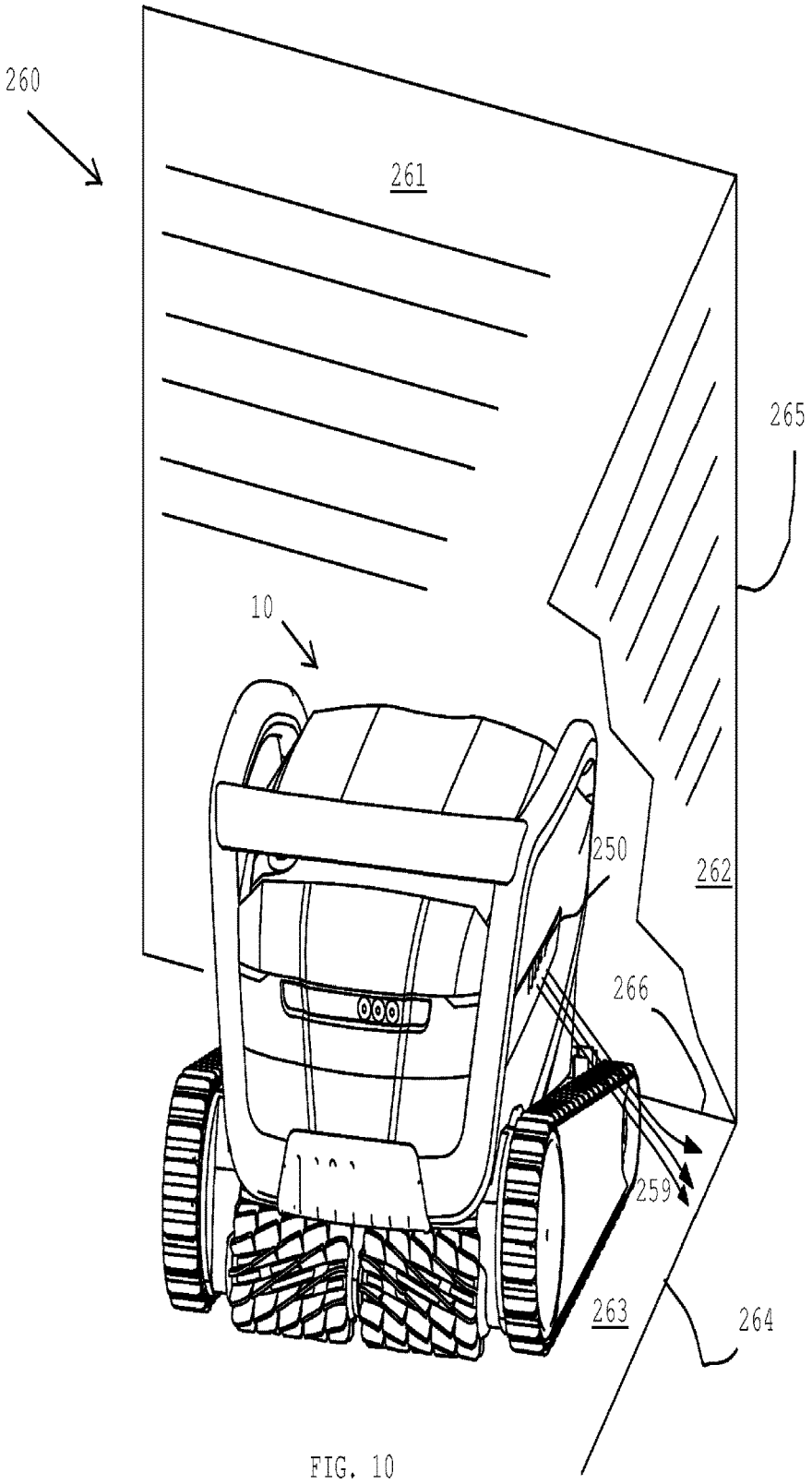
FIG. 10 illustrates an example of a pool cleaner located within a pool.

FIG. 10 illustrate spool cleaner 10, pool 260 including a first sidewall 261 that faces the rear of the pool cleaner, a second sidewall 262 that faces a sidewall of the pool cleaner 10 and a bottom 263. Corner 264 is formed between bottom 263 and second sidewall 262. Corner 265 is formed between first and second sidewalls 261 and 262. Corner 266 is formed between bottom 263 and first sidewall 261.

FIG. 10 illustrates a fluid jet 259 that is ejected from left sideway facing grille 250 towards corner 264.

Figure 11:
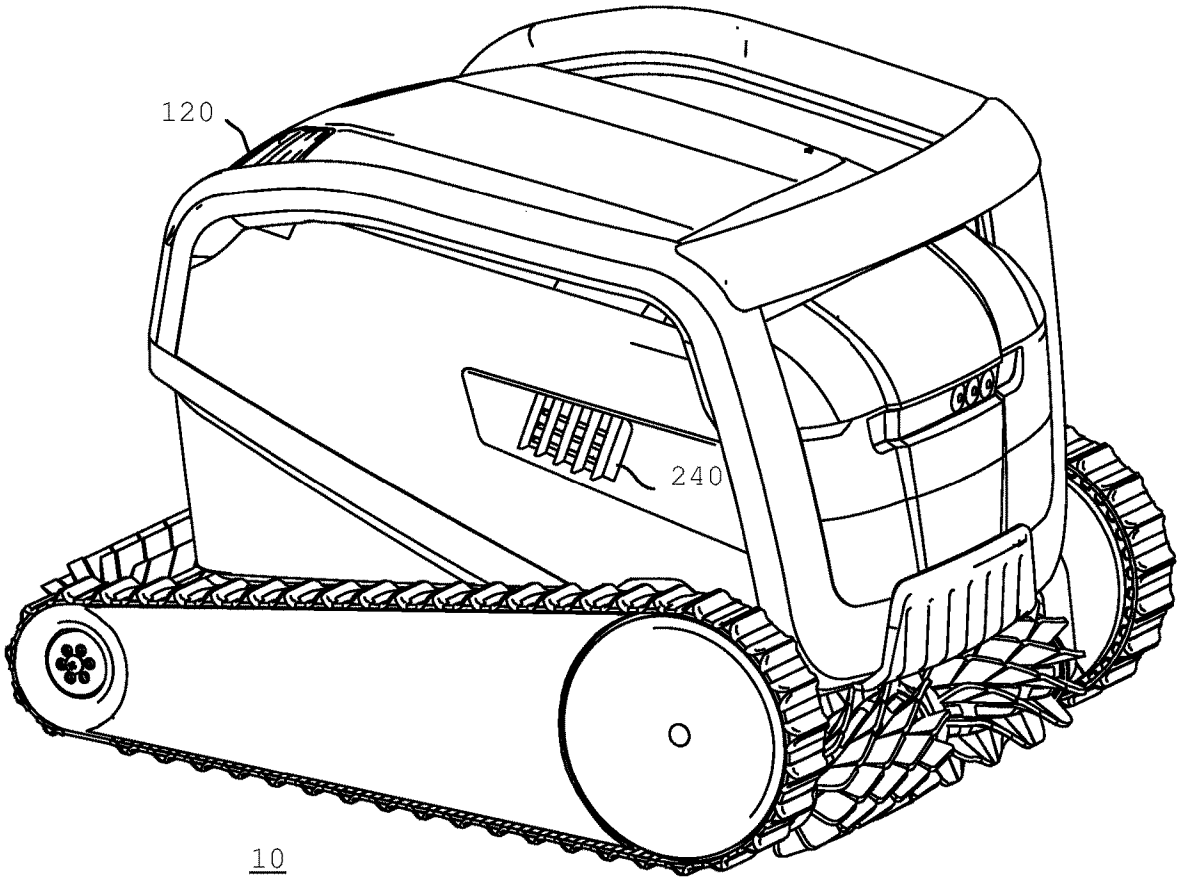
FIG. 11 illustrates an example of a pool cleaner.

FIG. 11 illustrates an example of a pool cleaner 10—and shows right grille 120 and right sideway facing grille 240. The right sideway facing grille 240 includes vertical panes and horizontal panes.

Figure 12:
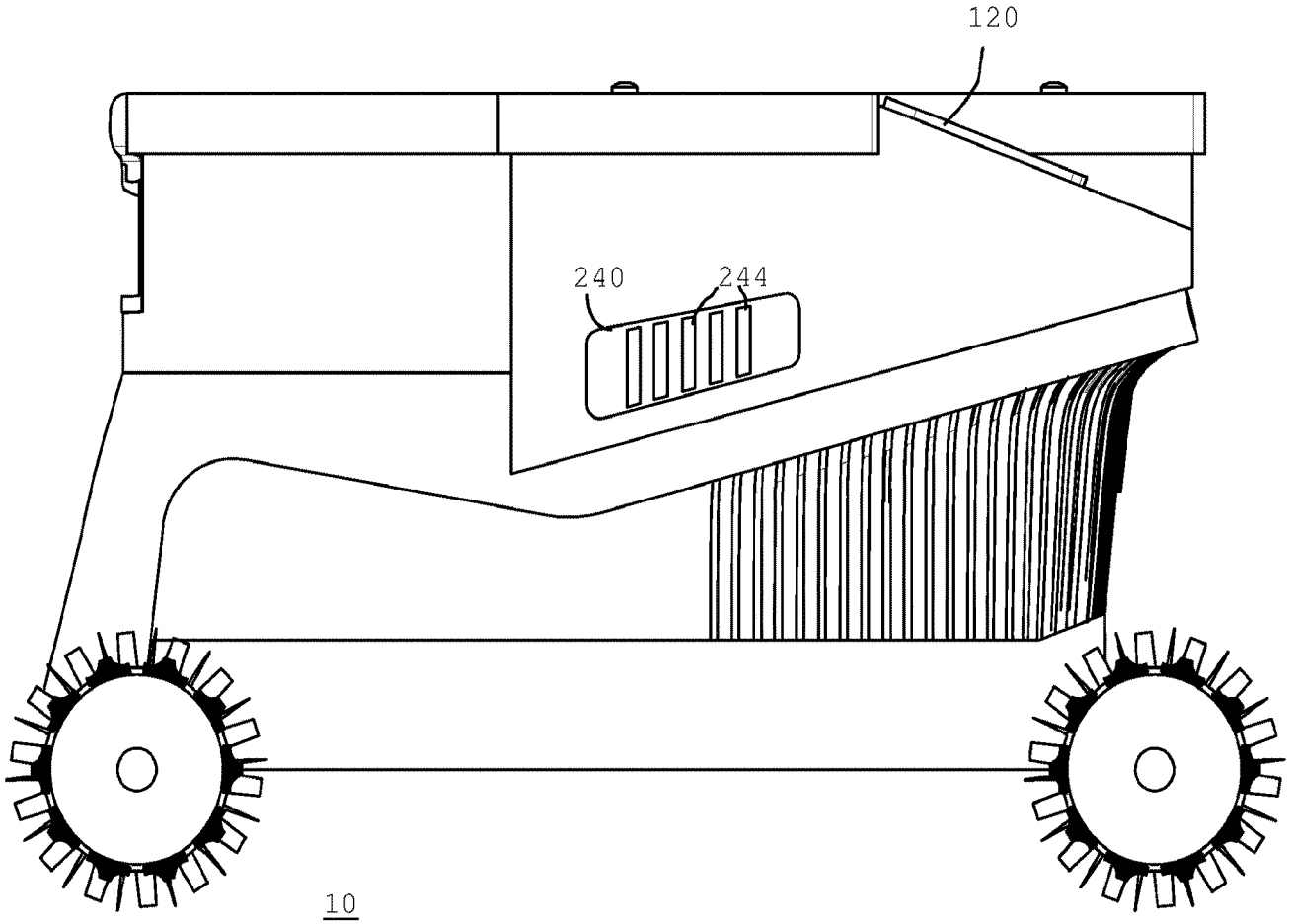
FIG. 12 is a side view of an example of a pool cleaner.

FIG. 12 illustrates an example of a pool cleaner 10—and shows right grille 120 and right sideway facing grille 240. The right sideway facing grille 240 includes vertical panes and does not include horizontal panes.

Figure 13:
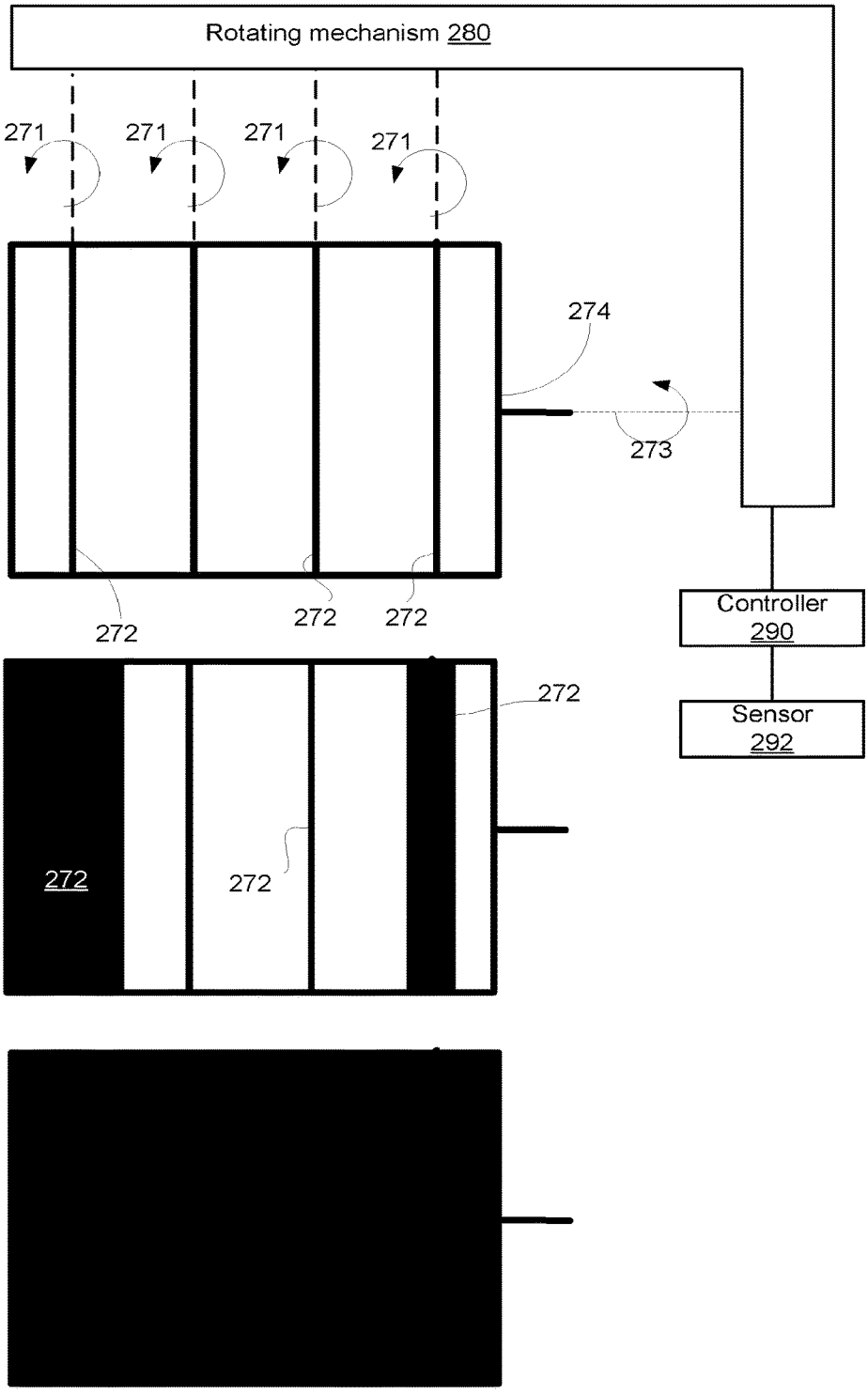
FIG. 13 illustrates an example of a controller, a sensor, a rotating mechanism and a grille that is positioned at three different positions.

FIG. 13 illustrates an example of a controller 290, a sensor 292, a rotating mechanism 280 and a grille that is positioned at three different positions.

The sensor 292 may send detection signals that may be processed by controller 290 to indicate that the pool cleaner is proximate to (for example—less than a predefined distance such as 5-90 centimeters from) a corner. The sensor may be any type of sensor including a sonar, an image sensor, and the like.

The controller 290 may control the rotating mechanism 280 in order to move the panes of a grille (such as grilles 110, 120, 240 and 250) in order to clean the corner.

The controller 290 may control the rotating mechanism 280 in any manner to perform (or assist in performing) navigation and/or climbing tasks.

In FIG. 13 the grille has a housing 274 that is rotatable about horizontal axis 273 while panes 272 are rotatable about vertical axis 271.

FIG. 13 illustrates the grille as being fully open (top part of the figure), be closed (bottom part of the figure) and being in an intermediate position in which one pane (leftmost pane) is fully closed and another pane (rightmost pane) is partially closed.

Figure 14:
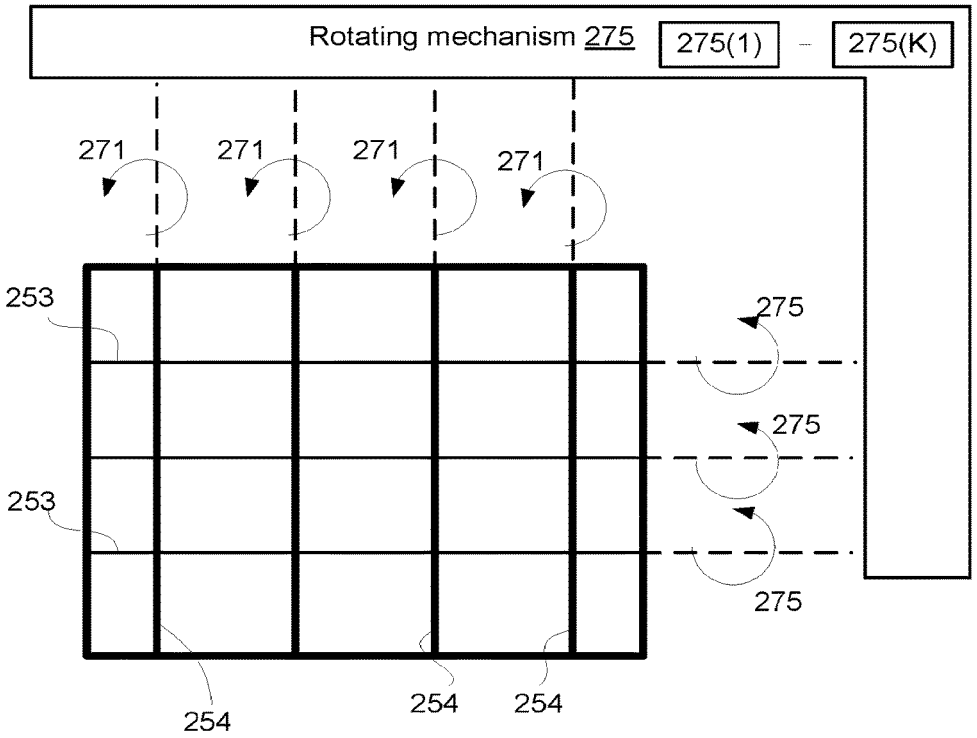
FIG. 14 illustrates an example of a rotating mechanism and a grille.

FIG. 14 illustrates an example of a rotating mechanism and a grille that has vertical panes 254 (rotated about vertical axis 271) and horizontal panes 253 (rotated about horizontal axis 275.

The different panes may be rotated by rotating mechanism 275 that may include one or more motors 275(1)-275(K), K being a positioning integer.

Figure 15:
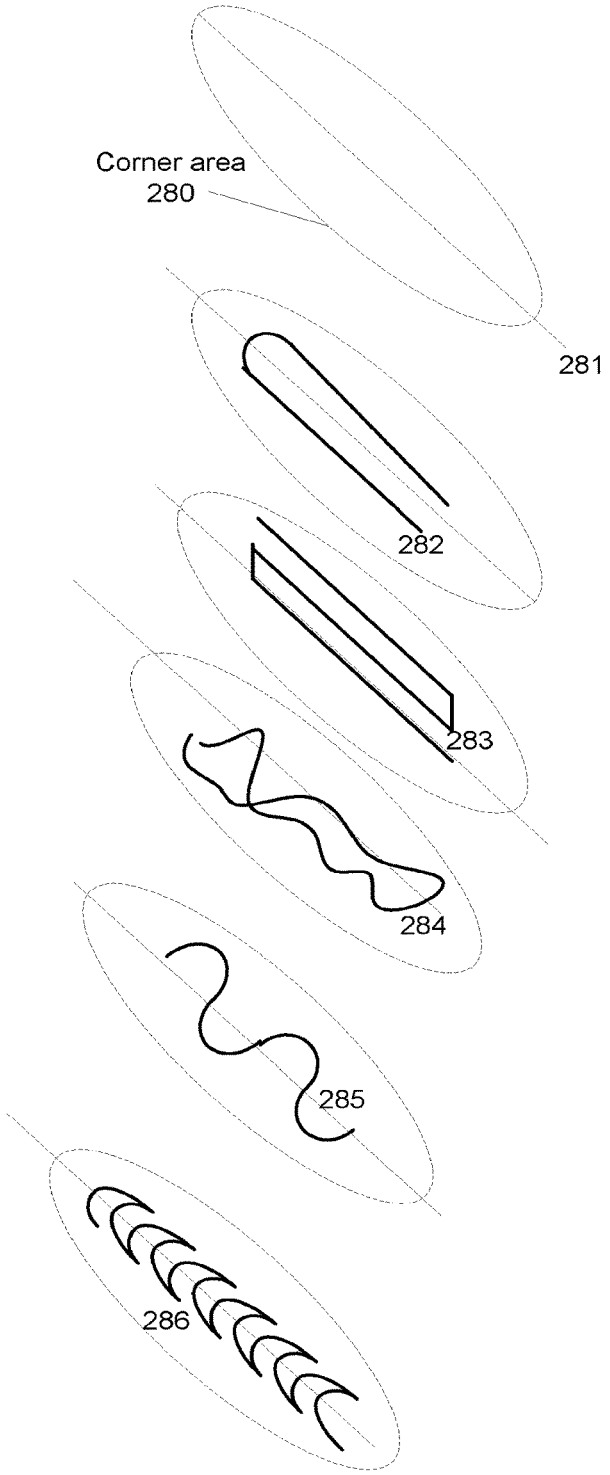
FIG. 15 illustrates examples of cleaning patterns of a corner area that includes a corner of a pool.

FIG. 15 illustrates examples of cleaning patterns of a corner area 280 that includes a corner of a pool. The corner area 280 may surround the corner 281. The fluid ejected from the pool cleaner may follow any pattern—such as patterns 282, 283 (raster scan), 284, 285, and 286.

Figure 16:
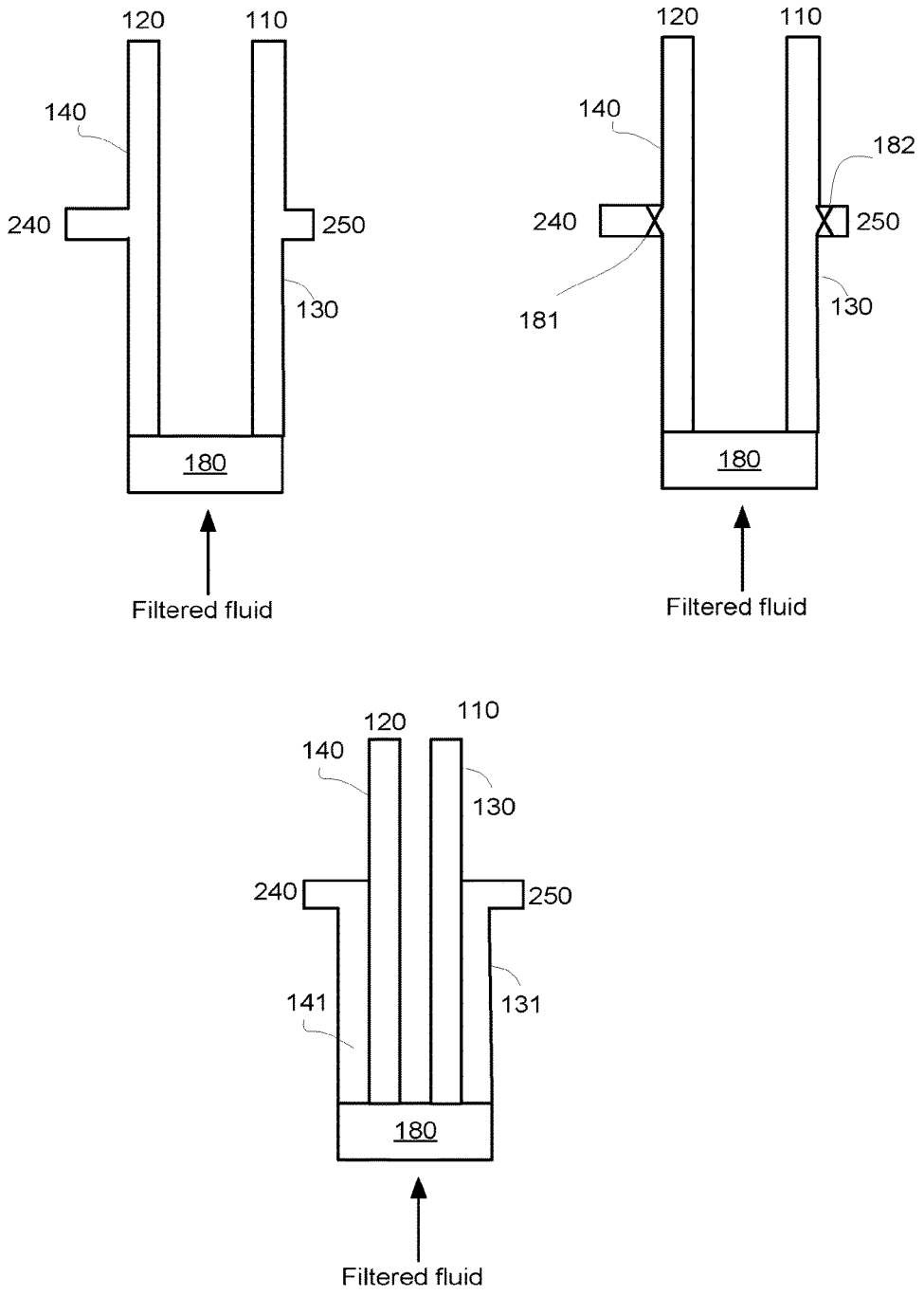
FIG. 16 illustrates examples of various components of the pool cleaner.

FIG. 16 illustrates examples of various components of the pool cleaner.

Intermediate element 180 may receive filtered fluid.

The intermediate element 180 may feed one or more fluid conduits out of right fluid conduit 140 and left fluid conduit 130.

Right fluid conduit 140 may feed right sideway facing grille 240 and right grille 120. Left fluid conduit 130 may feed left sideway facing grille 250 and left grille 110.

Alternatively—right sideway facing grille 240 may be fluidly coupled to the right fluid conduit 140 via a flow control element 181 and/or left sideway facing grille 250 may be fluidly coupled to the left fluid conduit 130 via a flow control element 182.

Alternatively—intermediate element 180 may be fluidly coupled to right sideway facing grille 240, right grille 120, left sideway facing grille 250 and left grille 110 via four different fluid conduits —141, 140, 131 and 130 respectively.

The filtered fluid may be provided to any grille using any fluid distribution system.

It has been found that splitting a single jet outlet into at least two rear outlets is beneficial insofar as the thrust force generated and the costs benefits associated with this said configuration.

The rear jet thrust that may exit the conduits outlets at varying angles of say 30 or 45 degrees serve to drive, or assist with the driving the pool cleaning robot by exerting a top force to keep the cleaner attached to the pool surfaces, to drive in a right or left direction, to improve overall movement stability on the pool surfaces and especially the wall climbing movement quality.

By moving both fluid conduits to the sides of the pool cleaner from the center, additional space is made available to enlarge the filtering or sieving element in between.

It was further established that while the combined said outlet aperture openings sizes of say, two conduits may be equal to the aperture opening size of a single outlet aperture as depicted in U.S. Pat. No. 9,222,275, the thrust forces achieved in each of the said two or more conduits is higher when splitting the outlet opening into two or more such openings. The faster fluid acceleration in the outputting conduits are higher than the one achieved in a single output outlet.

Furthermore, by splitting the rear outlet conduits, better control over the rate of fluid thrusts from both or each outlet may be achieved whereby, the nozzle manipulator that is described below is able to control full or partial flows to the one or more ducts without any leakage of fluid into another duct.

The cleaning robot may be provided with a thrust angle grille positioned at each of the outlet apertures—of each left or right fluid conduits—arranged so that the grille is positioned at a certain angle with further angles provided by the angle positioning of each pane of the said grille that controls the angle of the outputted water jet thrusts from the fluid conduits and the cleaning robot.

The pane may be directionally motorized to be automatically moved at various angles, both horizontally and vertically in order to direct the outputted fluid jet thrusts at different required angles according to the task to be performed.

Varying directional angles may be a function of necessary navigational maneuvering and/or necessary cleaning parameters whereby fluid jet thrusts are being used directionally.

The varying navigational or cleaning directional fluid jet thrust may be automatically determined by a controller.

For example—the when the pool cleaner climbs a sidewall of the pool there may be a need to increase thrust—which may be obtained by closing one or more panes of a grille and leaving one or more other panes of the grille closed and/or by closing panes of a sidewall grille and maintaining at least one pane of a rear grille open.

Yet for another example—panes of one or more grilles may be used to provide minute directional balancing controls while climbing stairs, while recognizing positioning on stairs to activate measured, non-random directional pane movements directed at predetermined angles that may be actively defined and successively corrected according to the angle of the housing in relation to the planar surfaces of the pool.

One or more panes of one or more grilles may be moved according to a pattern in order to remove dirt while climbing on stairs and/or to remove dirt from corners when travelling alongside a wall.

A cleaning process may include moving one or more panes of a grille along a pattern and then moving the one or more panes along an opposite pattern—or along the same pattern but in a reverse direction. For example—the one or more panes may be moved clockwise and then moved counterclockwise. Yet for example—one or more panes of a grille may be moved at a first direction thereby scanning an output jet upwards and then may be moved to another direction thereby scanning the output jet downwards. The cleaning process may include any combination of jet movements including linear and non-linear jet movements. For example—the fluid may be moved along a raster-scan pattern, a circular pattern, and the like.

A cleaning process may include changing a fluid resistance of a grille by closing or opening one or more panes of the grille and/or by tilting one or more panes of the grille. Lower fluid resistance may be achieved when all the panes are open and are parallel to a reference direction such as the direction of flow of fluid when approaching the grille (for example—the position illustrated in FIG. 4). The fluid resistance may be increases when tilting one or pane in relation to the reference direction—and especially when one or more of the panes is closed (positioned substantially normal to the reference direction).

The change in the fluid resistance may affect the force of fluid that exits through the grille.

For example—when a pane is closed the pressure of the fluid that exits the grille may increase in comparison to a state in which the pane is open.

Some of the figures illustrate front brush wheels 82 and some illustrate rear brush wheels 80—any combination of one or more brush wheels (including an intermediate brush wheel positioned between the rear and the front of the housing) may be provided.

It should be noted that the tracks and wheels 20 may be replaced by wheels or any other interfacing elements. For example—FIG. 9 illustrates a pool cleaner without tracks 20—that uses brush wheels 21 for moving the pool cleaner.

Figure 17:
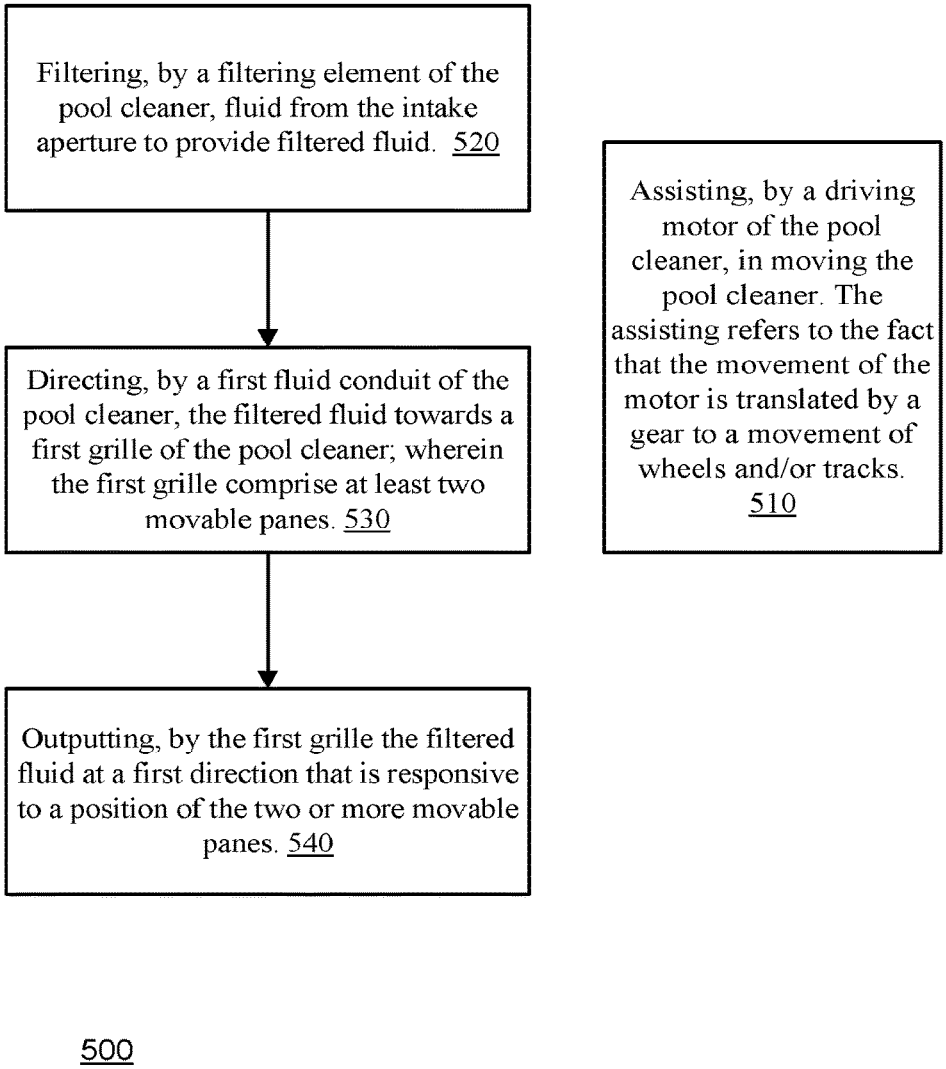
FIG. 17 illustrates a method.

FIG. 17 illustrates method 500,

Method 500 may include:

a. Step 510 of assisting, by a driving motor of the pool cleaner, in moving the pool cleaner. The assisting refers to the fact that the movement of the motor is translated by a gear to a movement of wheels and/or tracks. Step 510 may be executed before steps 520-540, after steps 520-504 and/or during steps 520-540.

b. Step 520 of filtering, by a filtering element of the pool cleaner, fluid from the intake aperture to provide filtered fluid.

c. Step 530 of directing, by a first fluid conduit of the pool cleaner, the filtered fluid towards a first grille of the pool cleaner; wherein the first grille includes at least two movable panes.

d. Step 540 of outputting, by the first grille the filtered fluid at a first direction that is responsive to a position of the two or more movable panes.

Method 500 may also include controlling a position of the at least two movable panes.

There may be provided a non-transitory computer readable medium that stores instructions that once executed by a pool cleaning robot, causes the pool cleaning robot to perform the steps of sensing by a pool cleaning robot an occurrence of an event that may be associated with a generation of the human perceivable signals; and executing by the pool cleaning robot and based on the sensing at least one out of generating at least some of the human perceivable signals by the pool cleaning robot; and requesting from another device to generate one or more of the human perceivable signals.

There may be provided a pool cleaning robot that comprises at least one sensor for sensing an occurrence of an event that may be associated with a generation of the human perceivable signals; and at least one of a transmitter and a human perceivable signals generator (such as one or more speaker or other sound generators). The human perceivable signals generator may be configured to generate, based on the sensing, at least some of the human perceivable signals. The transmitter is configured to transmit a request, based on the sensing, for another device to generate one or more of the human perceivable signals.

The terms "including", "comprising", "having", "consisting" and "consisting essentially of" are used in an interchangeable manner. For example—any method may include at least the steps included in the figures and/or in the specification, only the steps included in the figures and/or the specification. The same applies to the pool cleaning robot and the mobile computer.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one as or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements the mere fact that certain measures are recited in mutually different claims does not indicate that a combination of these measures cannot be used to advantage.

Any system, apparatus or device referred to this patent application includes at least one hardware component.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A pool cleaner comprising:

a housing;

a driving motor that is configured to assist in moving the pool cleaner;

a filtering element that is at least partially surrounded by the housing;

an intake aperture;

a first fluid conduit; and a first grille that comprises two or more movable first panes;

wherein the filtering element is configured to filter fluid from the intake aperture to provide filtered fluid;

wherein the first fluid conduit is configured to direct the filtered fluid towards the first grille; and wherein the first grille is configured to output the filtered fluid at a first direction that is responsive to a position of the two or more movable panes.

2. The pool cleaner according to claim 1 comprising a first movement mechanism for moving the two or more movable first panes.

3. The pool cleaner according to claim 2 wherein the first movement mechanism is configured to rotate the two or more movable first panes along a single axis of rotation.

4. The pool cleaner according to claim 2 wherein the first movement mechanism is configured to rotate the two or more movable first panes along two axes of rotation, wherein the two axes of rotation are oriented to each other.

5. The pool cleaner according to claim 1 wherein the first grille is positioned at a rear part of the housing.

6. The pool cleaner according to claim 1 wherein the first grille is positioned at a sidewall of the housing.

7. The pool cleaner according to claim 1 wherein the first grille is positioned at a cover of the housing.

8. The pool cleaner according to claim 1 comprising:

a second grille that comprises two or more movable second panes;

a second fluid conduit;

an intermediate element that is positioned between the filtering element and the first and second fluid conduit; wherein the intermediate element is configured to distribute the filtered fluid to at least one of the first and second fluid conduit;

wherein when the second fluid conduit receives a portion of the filtered fluid, the second fluid conduit is configured to direct the portion of the filtered fluid towards the second grille; and wherein the second grille is configured to output the portion of the filtered fluid at a second direction that is responsive to a position of the two or more movable second panes.

9. The pool cleaner according to claim 8 comprising a second movement mechanism for moving the two or more movable second panes.

10. The pool cleaner according to claim 9 wherein the second movement mechanism is configured to rotate the two or more movable second panes along a single axis of rotation.

11. The pool cleaner according to claim 9 wherein the second movement mechanism is configured to rotate the two or more movable second panes along two axes of rotation, wherein the two axes of rotation are oriented to each other.

12. The pool cleaner according to claim 1 comprising:

an intermediate element;

a group of fluid conduits; and a group of grilles that comprises the first grille;

wherein each grille of the group of grilles comprises at least two movable panes;

wherein the intermediate element is configured to distribute the filtered fluid to at least one of the group of fluid conduits;

wherein when a fluid conduit of the group of fluid conduits receives a portion of the filtered fluid, the fluid conduit is configured to direct the portion of the filtered fluid towards a corresponding grille of the group of grilles; and wherein the corresponding grille is configured to output the portion of the filtered fluid at a direction that is responsive to a position of the at least two movable panes of the corresponding grille.

13. The pool cleaner according to claim 12 wherein the group of grilles comprises at least one grille that comprises at least two movable panes that are configured to output a portion of the filtered fluid at a direction that is oriented to a sidewall of the housing and is oriented to a bottom of the housing.

14. The pool cleaner according to claim 12 wherein the group of grilles comprises at least one grille that comprises at least two movable panes that are configured to output a portion of the filtered fluid at a direction that has a projection that is parallel to a direction of an imaginary line that stretches between a center of the pool cleaner and a corner of the housing.

15. The pool cleaner according to claim 12 comprising a sensor and a controller, wherein the sensor is configured to generate detection signals indicative of a surrounding of the pool cleaner; and wherein the controller is configured to: detect, based on the detection signals, that a corner of a pool is within a cleaning distance from the pool cleaner; and initiate a corner cleaning process during which a grille of the group directs fluid towards the corner of the pool.

16. The pool cleaner according to claim 1 comprising a sensor and a controller, wherein the sensor is configured to generate detection signals indicative of a surrounding of the pool cleaner.

17. The pool cleaner according to claim 16 wherein the controller is configured to:

detect, based on the detection signals, that a corner of a pool is within a cleaning distance from the pool cleaner; and initiate a corner cleaning process during which the first grille directs fluid towards the corner of the pool.

18. The pool cleaner according to claim 1 comprising a sensor and controller, wherein the controller is configured to control a movement of the two or more panes of the first grille during a cleaning process.

19. The pool cleaner according to claim 1 comprising a sensor and controller, wherein the controller is configured to control a movement of the two or more panes of the first grille during a climbing on a sidewall of a pool.

20. The pool cleaner according to claim 1 comprising a sensor and controller, wherein the controller is configured to control a movement of the two or more panes thereby increasing a pressure of a flow of fluid that exits the first grille during a climbing on a sidewall of a pool.

21. The pool cleaner according to claim 1 comprising a sensor and controller, wherein the controller is configured to control a movement of the two or more panes of the first grille during a climbing on stairs of a pool.

22. A method for operating a pool cleaner, the method comprises assisting, by a driving motor of the pool cleaner, in moving the pool cleaner;

filtering, by a filtering element of the pool cleaner, fluid from an intake aperture to provide filtered fluid;

directing, by a first fluid conduit of the pool cleaner, the filtered fluid towards a first grille of the pool cleaner; wherein the first grille comprises at least two movable panes; and outputting, by the first grille the filtered fluid at a first direction that is responsive to a position of the at least two movable panes.

23. The method according to claim 22 further comprising controlling a position of the at least two movable panes.

* * * * *